US005913543A

United States Patent [19]

Curiel

[11] Patent Number: 5,913,543

[45] Date of Patent: Jun. 22, 1999

[54] TAMPER EVIDENT AND COUNTERFEIT RESISTING INFORMATIONAL ARTICLE AND ASSOCIATED METHOD

[75] Inventor: Yoram Curiel, Aurora, Colo.

[73] Assignee: Optical Security Group, Inc., Denver, Colo.

[21] Appl. No.: 08/681,791

[22] Filed: Jul. 29, 1996

Related U.S. Application Data

[60] Continuation-in-part of application No. 08/341,662, Nov. 17, 1994, which is a division of application No. 08/213,561, Mar. 16, 1994, Pat. No. 5,370,763, which is a continuation of application No. 07/915,975, Jul. 17, 1992, abandoned.

[51] Int. Cl.[6] ..... B42D 15/00

[52] U.S. Cl. ..... 283/94

[58] Field of Search ..... 283/103, 91, 904, 283/85, 77, 117, 94, 86

[56] References Cited

U.S. PATENT DOCUMENTS

| | | | |
|---|---|---|---|
| 2,400,079 | 5/1946 | Ducey | 40/135 |
| 2,610,421 | 9/1952 | Horn | 40/102 |
| 3,069,793 | 12/1962 | Francescon | 40/2.2 |
| 3,582,439 | 6/1971 | Thomas | 161/5 |
| 3,634,657 | 1/1972 | Ballard et al. | 235/61.11 D |
| 3,655,494 | 4/1972 | Buzzell | 161/5 |
| 4,017,994 | 4/1977 | Fraser | 40/2.2 |
| 4,134,842 | 1/1979 | Orkin et al. | 252/12.6 |
| 4,241,198 | 12/1980 | Kobayashi | 525/360 |
| 4,246,307 | 1/1981 | Trautwein | 428/43 |
| 4,324,421 | 4/1982 | Moraw et al. | 283/7 |
| 4,368,979 | 1/1983 | Ruell | 356/71 |
| 4,378,392 | 3/1983 | Segel | 428/40 |
| 4,389,472 | 6/1983 | Neuhaus et al. | 430/10 |
| 4,429,015 | 1/1984 | Sheptak | 428/201 |
| 4,510,006 | 4/1985 | Lawson | 156/235 |
| 4,562,102 | 12/1985 | Rabuse et al. | 428/43 |
| 4,563,024 | 1/1986 | Blyth | 350/320 X |
| 4,627,642 | 12/1986 | Peronneau et al. | 283/92 |
| 4,631,222 | 12/1986 | Sander | 428/172 |
| 4,662,653 | 5/1987 | Greenaway | 350/3.7 |
| 4,684,795 | 8/1987 | Colgate, Jr. | 235/457 |

(List continued on next page.)

FOREIGN PATENT DOCUMENTS

| | | |
|---|---|---|
| 2026750 | 2/1980 | United Kingdom . |
| WO8903760 | 5/1989 | WIPO . |

*Primary Examiner*—Willmon Fridie, Jr.

*Attorney, Agent, or Firm*—Arnold B. Silverman; Eckert Seamans Cherin & Mellott, LLC

[57] ABSTRACT

The present invention is directed toward a tamper evident informational article such as a temporary vehicle registration which may be made of paper or paperboard. The informational article has a zone for inserting information and a pattern within said zone which will resist effective counterfeiting. A transparent tape which preferably has a silicone resin coating which contains a wax is adhesively secured over information contained within the zone. In other embodiments, an alteration resistant article contains variable data and includes an outer film having an upper surface and a lower surface with an adhesive secured to the lower surface. A hologram for receiving at least a portion of the variable data on the upper surface is secured to the outer film lower surface and, in one embodiment, the hologram has portions which have release properties and portions which have greater adhesive bonding properties than the release containing portions. These respective portions may be established by providing a release material on certain portions of the upper surface of the hologram and providing adhesive enhancing materials on other portions of the hologram upper surface. The hologram may be embossed and have a metallized upper surface. A plurality of relatively small hologram particles may be provided in the outer layer and/or the adhesive layer. The hologram is secured to a substrate which, in one embodiment, has an upper surface printed with pattern means which are printed to a lesser depth than the variable data. In another embodiment, the hologram is provided as a unit with the outer film and overlies the variable data. Associated methods are provided. The invention may be employed in vehicle temporary registration permits, as well as in other uses.

28 Claims, 6 Drawing Sheets

U.S. PATENT DOCUMENTS

| | | | |
|---|---|---|---|
| 4,749,084 | 6/1988 | Pereyra | 206/459 |
| 4,786,084 | 11/1988 | Karney et al. | 283/91 |
| 4,807,807 | 2/1989 | Glick | 229/92.8 |
| 4,810,544 | 3/1989 | Hickman | 428/40 |
| 4,837,061 | 6/1989 | Smits et al. | 428/40 |
| 4,856,857 | 8/1989 | Takeuchi et al. | 350/3.6 |
| 4,897,533 | 1/1990 | Lyszczarz | 235/487 |
| 4,938,830 | 7/1990 | Cannistra | 156/270 |
| 4,971,646 | 11/1990 | Schell et al. | 156/244.17 |
| 4,978,415 | 12/1990 | Jones | 156/517 |
| 4,999,075 | 3/1991 | Coburn, Jr. | 156/209 |
| 5,077,001 | 12/1991 | Makowka | 383/5 |
| 5,120,383 | 6/1992 | Takei et al. | 156/240 |
| 5,128,391 | 7/1992 | Shustack | 522/92 |
| 5,149,571 | 9/1992 | Croell | 428/40 |
| 5,154,962 | 10/1992 | Mertens et al. | 428/40 |
| 5,248,544 | 9/1993 | Kaule | 428/195 |
| 5,267,753 | 12/1993 | Chock | 283/58 |
| 5,370,763 | 12/1994 | Curiel | 156/277 |
| 5,413,234 | 5/1995 | Hekal et al. | 215/230 |
| 5,468,540 | 11/1995 | Lu | 428/156 |
| 5,489,123 | 2/1996 | Roshkoff | 283/81 |

TAMPER EVIDENT AND COUNTERFEIT RESISTING INFORMATIONAL ARTICLE AND ASSOCIATED METHOD

CROSS REFERENCE RELATED APPLICATION

This application is a Continuation-in-Part of U.S. Ser. No. 08/341,662, filed Nov. 17, 1994, which was a Divisional Application of U.S. Ser. No. 08/213,561, filed Mar. 16, 1994 (now U.S. Pat. No. 5,370,763), which was a Continuation of U.S. Ser. No. 07/915,975, filed Jul. 17, 1992 (now abandoned).

BACKGROUND OF THE INVENTION

1. Field of the Invention

The present invention relates to informational articles which are provided with a zone within which information will be provided either in handwritten or printed form and, more specifically, it relates to providing such an article wherein both counterfeiting, through photocopying, and alteration through manual or printed means are resisted.

The present invention also relates to an alteration resistant article which is adapted to have an end user adding variable data, such as custom variable data provided thereon prior to completion of the article and to a method of making the same. The invention is particularly suited to use in vehicle temporary registration permits for entering expiration dates and other information.

2. Description of the Prior Art

It has been known for many purposes to provide means to protect informational articles from counterfeiting and alteration. For example, with respect to paper currency, it has been known to use special inks, graphic designs, codes and materials to make it more difficult for counterfeiters to copy the currency.

It has also been known to protect cards from deterioration and alteration by encasing them between a pair of laminated plastic sheets.

It has also been known to employ holograms in credit cards so as to inhibit unauthorized reproduction.

A unique problem exists in respect of certain items which must be completed by an intermediary after initial manufacture prior to delivery to the end user. For example, in a typical motor vehicle temporary registration plate, the state has had printed on paper or paperboard all of the information required for the temporary registration which is to be employed until the permanent license plate is received, except the date of expiration. The date of expiration is typically applied by the use of a pen, marker or other printing means by the dealer at the time of sale. It is obviously important that the temporary plate be such that it cannot be easily counterfeited by photocopying and the information provided by the dealer as to expiration date cannot be altered.

With respect to many products, wherein a preprinted product is completed through the insertion of information, which may frequently be handwritten by pen, marker, or other means, depending upon the nature of the product and the distance from which one might wish to have the completed product viewed, i.e., the preprinted form, plus the subsequent insertion of customized handwritten insertions of variable data, there have been problems with respect to unauthorized alteration and counterfeiting. One of the items falling within this category is the temporary registration permit which is issued by states for use on vehicles, such as cars, trucks and buses which are licensed to operate within a given state. These permits are typically about the size of a license plate and have certain preprinted information from the state, including the temporary permit number, and have spaces for insertion by an auto dealer, for example, of vehicle identity information, such as the make and year of the vehicle, the vehicle identification number ("VIN") and the dealer identification. Generally in large print, which can read by a police officer and others at a substantial distance, the date of expiration of the permit is inserted by a marker so as to provide the information in highly visible wide lines.

One of the problems which has been encountered with respect to such vehicle temporary registration permits is the fact that an individual receiving the same can by use of a marker, having the identical color ink, alter the date of expiration. For example, a permit which originally was indicated as expiring on 07/01/96, could have the number "7" changed to a "9," thereby making the altered permit appear as if it were not going to expire for two months after the actual expiration date.

In my related U.S. Pat. No. 5,370,763, issued on Dec. 6, 1994, and entitled "Tamper Evident and Counterfeit Resisting Informational Article and Associated Method," I disclosed a system wherein after the customized information inserted by the auto dealer, or other authorized individual, is provided with a transparent tape which is adhesively bonded over the area of inserted information and is provided with an exterior write-resistant coating. This type of construction resists undesired alteration of the permit information. This patent also suggested the use of holograms in this region of the permit which contains inserted information so as to resist unauthorized photocopying of the permit.

The use of an overlying transparent adhesively secured tape and a relatively thin strip of underlying hologram extending along the length of the transparent film, but of lesser width has been known. It has been known to remove both the film and hologram and separate them and to apply to the substrate a strip of some generic diffraction material of the same size as the original hologram and to place new numbers on the substrate and to cover the same with another clear film made of cellophane tape. For a police officer viewing the permit from a passing car, or at a distance, it was difficult to tell such constructions from the original.

Another approach to unauthorized tampering has involved photocopying of the original permit, employing a masking material of the same color as the permit, such as that sold under the trade designation "White-Out" to cover the old expiration date, and then photocopying the newly created blank permit. Many copies could be made from this original. The hologram material, either a generic type, or hologram salvaged from prior expired temporary registration permits could then be glued onto the copy with the new expiration date written thereover, and cellophane tape provided thereover.

In spite of the foregoing known systems, there remains a need for informational articles, such as temporary vehicle registration plates, which will resist counterfeiting and alteration subsequent to the dealer's insertion of the required information.

It will be apparent, therefore, that for vehicle temporary registration permits and certain other documents, wherein a preprinted form is provided with customized variable information, there remains a need for such a product and method which will provide improved resistance to undesired tampering, counterfeiting and alteration.

SUMMARY OF THE INVENTION

The present invention has met the above-described need by providing a means for an informational article, such as a temporary license plate as supplied by the state, to inherently resist counterfeiting by photocopying and also further means to resist any alteration of the information inserted by the vehicle dealer.

The informational article has a preprinted side containing basic information, such as the state in which it is effective and a zone on such side for insertion of the expiration date by the dealer. It is obvious that such temporary plates must be sufficiently large as to be viewable from a substantial distance such that a law enforcement officer, for example, could without getting out of his or her vehicle, quickly determine whether the temporary vehicle registration has expired.

The present invention provides a pattern within the zone which preferably is a refractive image, such as a hologram so as to resist reproduction by a form of photocopying. Efforts to photocopy, even on paper of identical color as the original form would fail to reproduce the refractive image and thereby preclude photocopying as a means of counterfeiting the temporary registration plate.

Also, the invention contemplates the dealer after applying the date of expiration within the zone placing an adhesively bonded transparent tape which might be made of a polyester or polyolefin, for example, over that area. The tape preferably is covered with a write-resistant coating which is preferably a silicone resin to which a wax, such as polytetrafluoroethylene, has been added.

The method of the present invention involves providing such an informational article, inserting the information within the zone with at least a portion of it being on the pattern to resist reproduction and thereafter applying the write-resistant protective tape thereover to adhesively bond the same.

In one embodiment of the present invention, an alteration resistant article containing variable data includes an outer film having an upper surface and a lower surface and adhesive means secured to the lower surface. Hologram means for receiving variable data thereon and being secured by said adhesive means to said outer film are provided. In one embodiment, the hologram means has portions which have release properties so as to be bonded to the adhesive means less intimately than other portions of the hologram means. The hologram means are secured to an underlying substrate. As a result of the presence of portions of differential adhesive properties on the upper surface of the hologram, an effort to separate the hologram from the overlying outer film will result in part of the hologram being removed by the overlying film and the remainder remaining on the hologram, thereby impairing the ability of another to reuse the hologram.

Unlike prior art holograms, one feature of the present invention in an embodiment employing a metallized hologram, is that the metallized surface is disposed at the upper portion of the hologram and not the lower side.

Another aspect of the present invention involves employing small hologram particles, either within the outer film, or within the adhesive means which secure the outer film to the hologram means, or both. These serve to provide visual confirmation of the authenticity of the outer film material as distinguished from the use of any cellophane tape and impair the photocopying of the form, as such particles will reproduce by creating areas of contrast.

Another aspect of the present invention is the preferred use of ink of different viscosities with a high viscosity ink being employed to provide a printed pattern on the upper surface of the substrate on the preprinted form and the use by the end user of a thinner lower viscosity ink as by an appropriate marker which will penetrate into the substrate.

The hologram means may include an upper image layer, an underlying layer having release portions and enhanced adhesion portions, an underlying film, and an adhesive layer for securement to the substrate of the article.

The method of the present invention employs any of the foregoing embodiments and combinations thereof and contemplates the end user applying the variable data to the article such that it is applied in part to the article's substrate and in part to the hologram which, preferably, is of lesser height than the outer film, with the outer film being adhesively secured thereover, and containing a write-resistant outer layer.

It is an object of the present invention to provide an efficient means for resisting counterfeiting by photocopying or alteration of an information containing article.

It is a further object of the present invention to provide such an article and the associated method wherein the original form must have information added to it before it can become effective.

It is a further object of the present invention to provide a refractive image in the zone in which the information is provided and for subsequent protective pressure-sensitive adhesive application of a write-resistant treated transparent tape.

It is a further object of the present invention to provide such a system which may be employed economically and without the need for special skills or equipment on the part of the individual completing the article by adding the required information.

It is an object of the present invention to provide a product and associated method which will resist undesired alteration of variable data contained in an article.

It is a further object of the present invention to provide such a system which not only will resist undesired writing on the exterior of the protective film, which overlies the variable data, but also will resist physical separation and reuse of the hologram and the use of photocopying to create counterfeit blank forms.

It is another object of the invention to provide zones of differential adhesion properties so as to facilitate destruction of the hologram and the substrate upper surface if an effort is made to separate the outer film from the hologram.

It is a further object of the invention to provide such a system where a police officer viewing a vehicle temporary registration permit will be able to confirm authenticity of the same with a reasonable degree of certainty.

It is a further object of the present invention to provide such a system which facilitates the use of a combination of security enhancing features.

It is another object of the present invention to provide such a system wherein the end user may affix the variable data in a conventional manner and complete the product without requiring any particular skill or substantial training.

It is a further object of the present invention to provide such a system wherein the integrity of variable data will be destroyed when the outer film is separated from the hologram and underlying substrate.

These and other objects of the invention will be more fully understood from the following description of the invention on reference to the illustration appended hereto.

DESCRIPTION OF THE PREFERRED EMBODIMENTS

As used herein, the term "refractive image" means any visually perceptible contrasting portion which has contrast increased upon exposure to either natural or artificial light and shall include, but not be limited to photographs, illustrations, printed patterns, colors, and holograms.

As used herein, the term "informational article" means an article or portion thereof which is intended to communicate information and will expressly include, but not be limited to temporary vehicle registration plates, security signs, labels and cards, checks, bank drafts, money orders, and other types of informational signs, labels, and cards.

As used herein, the terms "temporary registration permit" or "vehicle temporary registration permit" will refer to temporary vehicle registration plates which are issued by governmental units to confirm that a vehicle has been registered with the governmental unit.

As used herein, the term "variable data" refers to information added to an article as by an authorized vehicle dealer, for example, the alteration of which, or counterfeiting of which, is sought to be resisted and shall include, but not be limited to identification of a vehicle and/or a dealer and/or a date of expiration of the vehicle temporary registration permit.

The term "hologram particles" shall mean small pieces of a hologram, which are generally under about 1/32 to 1/4 inch in diameter or major dimension, depending upon shape, but are sufficiently large as to be visible with the naked eye.

Figure 1:
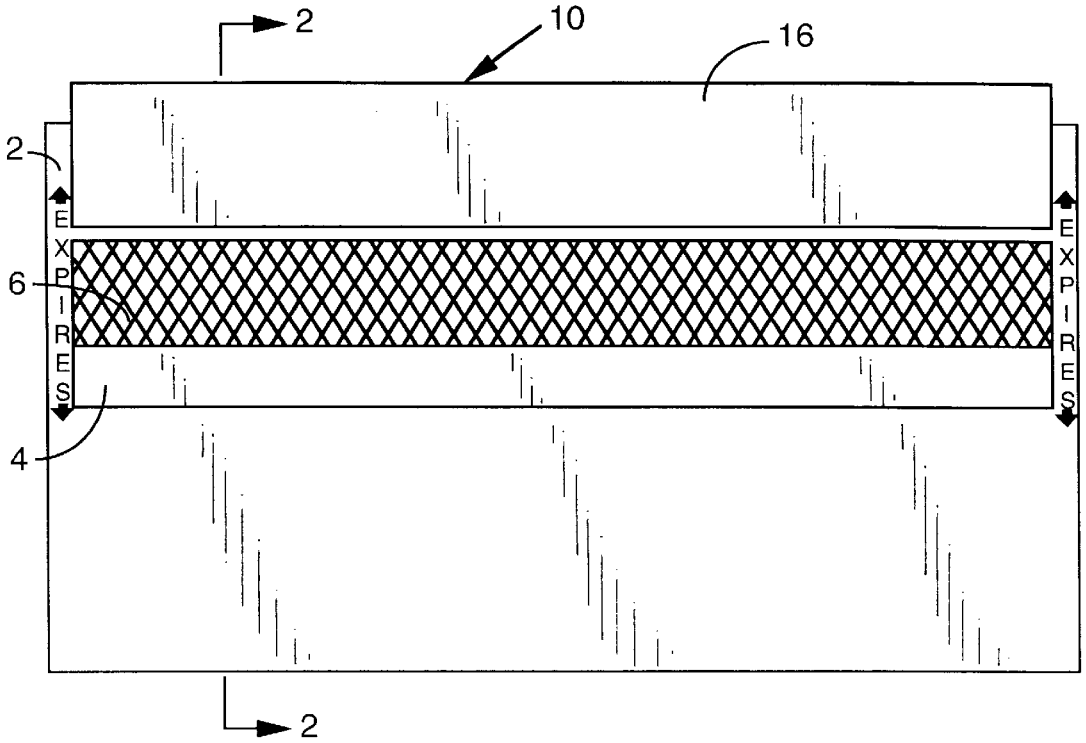
FIG. 1 is a front elevational view of a specimen temporary vehicle registration plate of the present invention.
Figure 2:
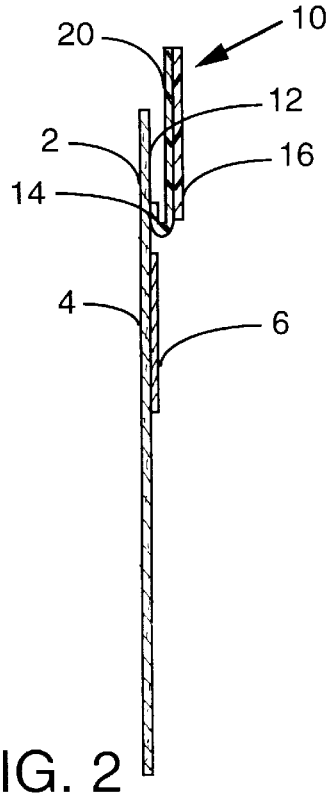
FIG. 2 is a cross-sectional illustration of the temporary plate of the present invention taken through 2—2 of FIG. 1.

Referring now in greater detail to FIGS. 1 and 2 there is shown a paper or paperboard temporary registration form prior to insertion of the expiration date. The form is generally rectangular in shape and may have the size on the order of about 8 to 12 inches by about 4 to 8 inches. It is printed on one side and, in the form shown, has information regarding the state in the upper horizontal portion 2. It also has a horizontal zone 4 underlying zone 2 within which the expiration date will be inserted by the vehicle dealer either by the use of a pen, or marker to provide a thicker line, or by suitable printing means. Zone 4 may be considered as having upper and lower limits between the arrow points disposed above and below the word "EXPIRES" on both sides of zone 4. The blank space underlying zone 4 may be employed to provide a vehicle serial number, if desired.

Within the zone 4 is a pattern 6 which preferably is a refractive image such that any effort to counterfeit the temporary registration form by photocopying will be defeated. The preferred form of refractive image would be a hologram which, in the form shown, has a plurality of repeated diamond shapes such that as the form is moved in either natural or artificial light, varying colors will be seen within each zone. As a result, even if one were to photocopy the blank form on paper or paperboard of the identical color employed by the state, the color produced by the hologram would not be duplicated in appearance. Further, even in the less preferred use of patterns or refractive images which do not have holograms, it is generally preferred to employ a pattern on a reflective background as this is difficult to photocopy. When the dealer sells a vehicle, he or she will insert, either manually or by printing means, in large numbers which can be viewed from a substantial distance, the date of expiration of the temporary registration within zone 4. The pattern 6 may be integrally provided in zone 4 or may be formed on a separate element which is adhesively bonded within zone 4 or provided as a coating.

Shown in FIGS. 1 and 2 is a tape member 10 which has been pre-secured to the printed face 12 of the temporary plate by suitable pressure-sensitive adhesive means within region 14 of the tape assembly 10 which can be either within zone 4 or adjacent thereto. The tape assembly 10 which is folded upwardly could be stored in a downward position overlying pattern 6. The tape assembly 10 has a strippable protective web 16 secured to the adhesive side of tape 20 to resist undesired premature sticking. Tape 20 is transparent and preferably composed of a material selected from the group consisting of polyester and polyolefins with polyethylene and polypropylene being among the preferred materials in the latter generic category. The information is inserted within zone 4 in at least partial overlying position with respect to pattern 6 which, preferably, is a continuous tape or coating, but may in the alternative, be segmented so as to provide discrete areas of the dates. Protective web 16 is then removed from tape 20 and protective web 16 is urged downwardly in overlying position with respect to the information provided in zone 4 and secured thereto in surface-to-surface contact by means of the pressure-sensitive adhesive on the undersurface of tape 20. If desired, tape assembly 10 may be provided as a separate member rather than one that was pre-secured.

The exposed surface of the protective web tape preferably has a coating of a silicone resin so as to resist any efforts to write thereon in a manner that would overlay and alter the dates. In the most preferred form of the invention, about 2½ to 10 percent by weight of a wax is incorporated in the silicone resin so as to enhance the write-resistant characteristics in respect of marker pens, crayons, pens, and the like. This renders the exposed surface of tape 20 non-wetting with respect to inks. The preferred silicone resin is a heat curable resin. The preferred wax is polytetrafluoroethylene.

Figure 3:
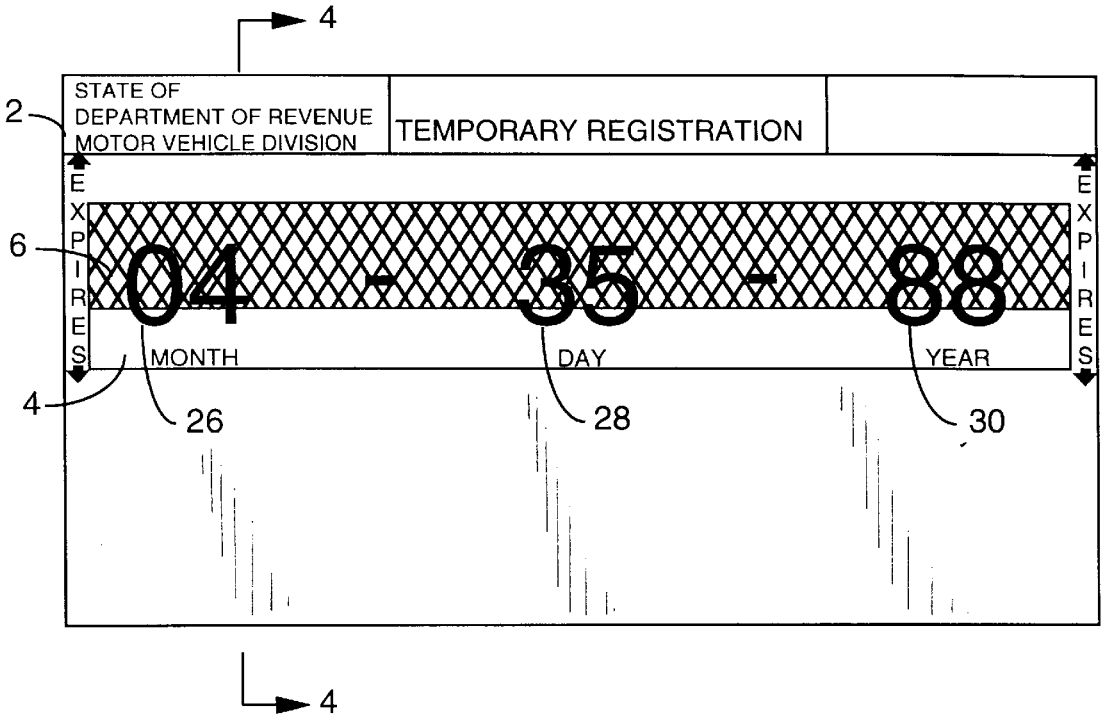
FIG. 3 is a front elevational view of the specimen temporary vehicle registration plate of FIG. 1 after insertion of the information and applying the protective means.
Figure 4:
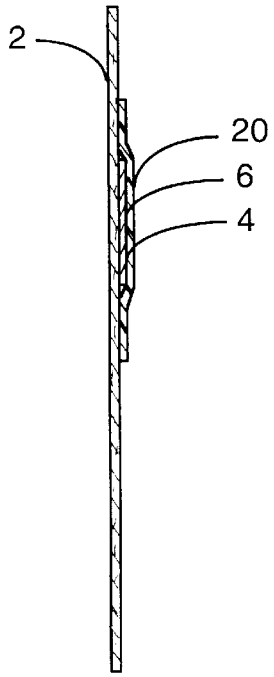
FIG. 4 is a cross-sectional illustration of the completed informational article of FIG. 3.

Referring to FIGS. 3 and 4, the completed temporary plate will be considered. As shown, the protective tape 20 overlies patterned portion 6 with the month 26, day 28, and year 30 being in partial overlying position with respect to the patterned portion 6 and partially overlying other portions of zone 4. Day 28 is shown as "35" for illustrative purposes only. In actual use, a number between 01 and 31 will be shown. The tape 20 is adhesively secured in overlying surface-to-surface position with respect to zone 4.

It will be appreciated that in this manner, any effort to either counterfeit the temporary registration form before or after completion will be resisted and the ability to either alter the numbers or write over the same will also be inhibited due to the presence of the transparent tape which has been protectively covered.

Further, any effort to lift tape 20 will result in the adhesive taking with it at least portions of the information receiving zone 4 which are not covered by pattern 6 and, if desired, portions of pattern 6. Suitable adhesives for use on the tape are an acrylic base pressure-sensitive adhesive for paper or paperboard articles and a rubber based adhesive for plastic articles, for example.

It will be noted that in the preferred embodiment the height of the pattern is about 40 to 60 percent of zone 4 in which the information will be inserted. In this manner, a portion of the numbers or other information will be applied over the pattern and a portion will not. The presence of a pattern underlying a portion of the number enhances the counterfeit protection. Also, the presence of the information on the article itself and on the pattern makes it more difficult for one to attempt to remove the tape without destroying the underlying materials.

The method of the present invention involves providing the appropriate form, inserting the desired information in at least partial overlying relationship with respect to the pattern and thereafter covering the information within the zone 4 by means of an adhesively bonded transparent tape member 20 which has its exterior surface write-resistant treated.

Figure 5:
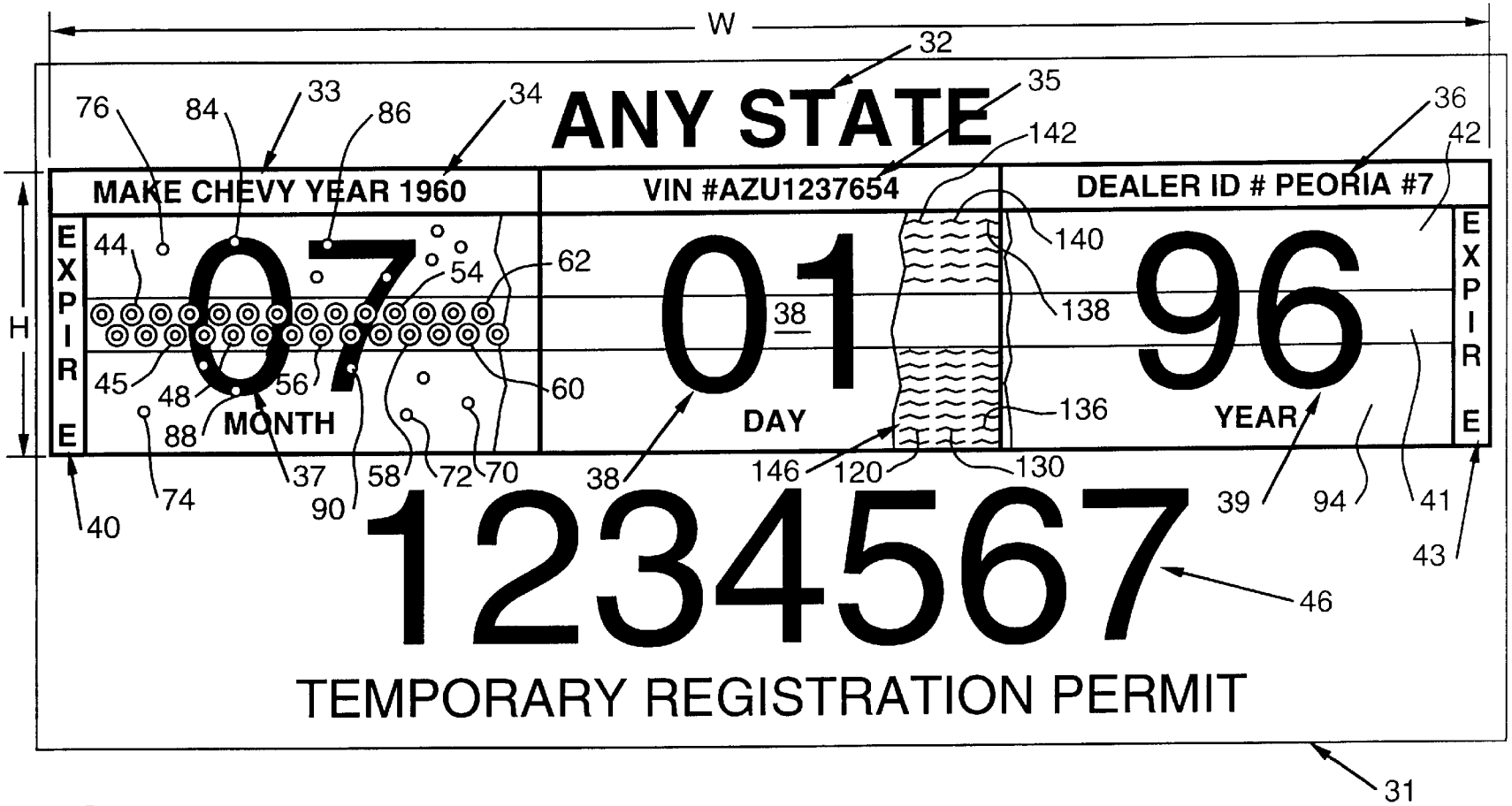
FIG. 5 is a partially schematic illustration of a form of vehicle temporary registration permit of the present invention.

Referring to FIG. 5, there is shown an example of an alteration resistant article of the present invention which takes the form of a vehicle temporary registration permit 31. These are typically on cardboard, are white or grey in color, and have dimensions of about 5 to 7 inches high by about 10 to 14 inches long. Among the types of variable data contained on this permit 31, are the state 32, the make of car 33, the model year of the car 34, the VIN number 35, the dealer identification number 36, and the date of expiration setting forth month 37, date 38, and year 39. The word "expires" appears in blocks 40 and 43 and the preprinted registration number 46 appears underlying the date. The form will generally be preprinted and the car make 6, year 8, VIN number 10, dealer identification 12, and date of expiration 20,22,24 are applied as variable data by the end user, which will generally be the vehicle dealer. After that, the vehicle dealer, in a manner to be described hereinafter, will complete the construction by establishing a secure alteration resistant construction.

Referring to FIG. 5, there is seen a hologram 41, which underlies a transparent outer film 42, which will be discussed hereinafter in greater detail. While the hologram 41 could be of greater height, if desired, and might even be substantially coextensive with outer film 41, in a preferred embodiment, the hologram will extend longitudinally generally in the same direction as the film 42 and have a lesser height than the film 42, which hologram height is preferably about 15 to 35 percent of the height of the outer film 42. The outer film 42 may be attached originally to the article, as shown in FIGS. 1 and 2, or may be separate and be secured in overlying variable data covering relation and preferably have a minimum height H, but can have a greater vertical extent and a width W extending generally to other portions of the boxes 40,43.

The hologram detail, for clarity of illustration, is shown solely in the block 37 containing the month, it being understood that it would preferably extend over all areas on which the dates 37,38,39 are inserted and, preferably, extend continuously across the width of the film 42. Also, it will be noted that the film 42 covers all of the variable data added by the end user or dealer.

The hologram 41 preferably has a metallized or partially metallized upper surface and, in the form shown, has a plurality of generally donut-shaped embossments, such as 44,45,48, for example. It will be appreciated that, in general, due to the desire to avoid deterioration of the metallized portion of the hologram in prior art practices, such a metallized surface would not face upwardly. In a preferred practice of the present invention, the hologram 41 is initially secured to the underlying substrate in a manner to be described hereinafter. After insertion of the variable data is applied over the substrate and hologram, after which the article is completed by causing the upper surface of the hologram 41 to be protectively adhesively secured to the overlying outer film 42. As the outer film 42 seals the metallized upper surface of the hologram 41, it is isolated from exposure to the atmosphere and, therefore, is protected from deterioration. It will be appreciated that a wide variety of holographic images, with or without metallizing, clear or opaque, and with or without embossment, including graphics, words and combinations thereof, may be employed so as to facilitate verification of authenticity and provide for a changing image depending upon the angle from which one views the assembly.

Another feature of the present invention is the use of hologram particles, such as 70,72,74,76, for example, which while shown solely in the month area 20, would be employed substantially coextensively with the outer film 36 in a randomly presented array. These hologram particles 70,72,74,76 serve a double purpose. First of all they, by providing a holographic image of relatively small size, they serve to further confirm the authenticity of the article as they make it more difficult to substitute an unauthorized replacement upper film. Secondly, they interfere with efforts to reproduce the form by a photocopying as they will appear within numbers, such as hologram particles 84,86,88,90, for example, and also will interfere with reproduction with a uniform background as the hologram particles will tend to provide either a darkened or blurred reproduction. It is preferred that the hologram particles be provided, (a) in the adhesive (not shown in this view) which bonds the lower surface of the outer film 42 to the underlying hologram 41 or substrate 94, or (b) in the outer film 42. The hologram particles may also be interposed between the outer film 42 and tile adhesive, or in all three locations. The hologram particles may be made from any desired hologram. They may, for example, be reflective, refractive, embossed and may contain graphic components or words. They may also contain combinations of the foregoing, if desired.

Figure 6:
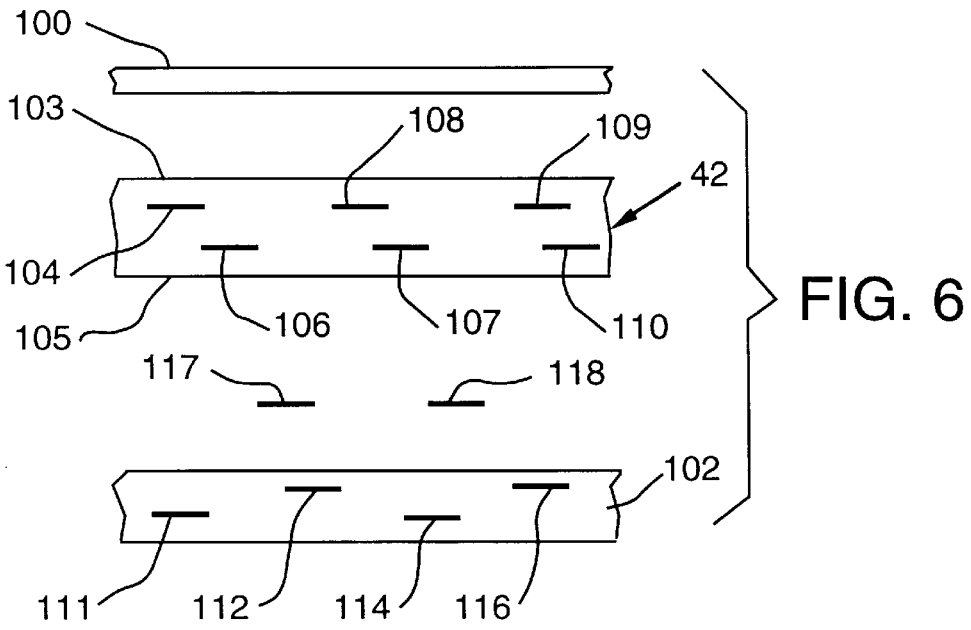
FIG. 6 is a fragmentary exploded view showing a portion of the upper layers of the permit of FIG. 5.

Referring to FIG. 6, which is an exploded view of a portion of the article, the outer film 42 has an upper surface 103 to which is secured a layer of write-resistant material 100, which serves to resist anyone writing over the portion of the temporary registration permit to which the transparent outer film 42 is secured. Outer film 42 has a lower surface 105 which is secured by means of adhesive layer 102 to the underlying hologram means (not shown in this view). In the preferred practice of this aspect of the invention, hologram particles 104,106,107,108,109,110 may be provided in the outer film by introducing them into the material to be made into the film, or in adhesive layer 102, as in the hologram particles 111,112,114,116, or between outer film 42 and adhesive layer 102, such as 117,118, or in combinations of the three options.

A further security measure is the provision of a pattern, such as that created by elements 120,130,136,138,140,142, in sector 146 on substrate 94. The pattern would preferably be a repetitive pattern of graphics, words, or combinations thereof, and would be visible through the outer film 42. If desired, the pattern may be provided in a micro-size image by printing or readable only with the use of magnification etching means, such as a magnifying glass. It is contemplated that the pattern means would be printed on the substrate surface 94 with a highly viscous ink which would keep the printing confined essentially to the surface area. By contrast, the end user would be instructed to apply the date 37,38,39 and, if convenient, the vehicle identification and dealer identification information by a low viscosity ink which will penetrate into the body of the permit 2. As a result, if one were to remove the outer film 42 and hologram 41 as a unit, the hologram 41 would remove the surface of the underlying cardboard substrate, and the outer film 42 would remove the pattern from the surface underlying the outer film 42, but the deep penetrating portions of the low viscosity ink would remain visible in the remaining portions of the substrate 94 underlying the outer film 42.

It will be appreciated that depending upon the degree of security desired and the specific nature of the use, one, more than one, or all of the hereinbefore described security features may be employed in a single alteration resistant article.

Figure 7:
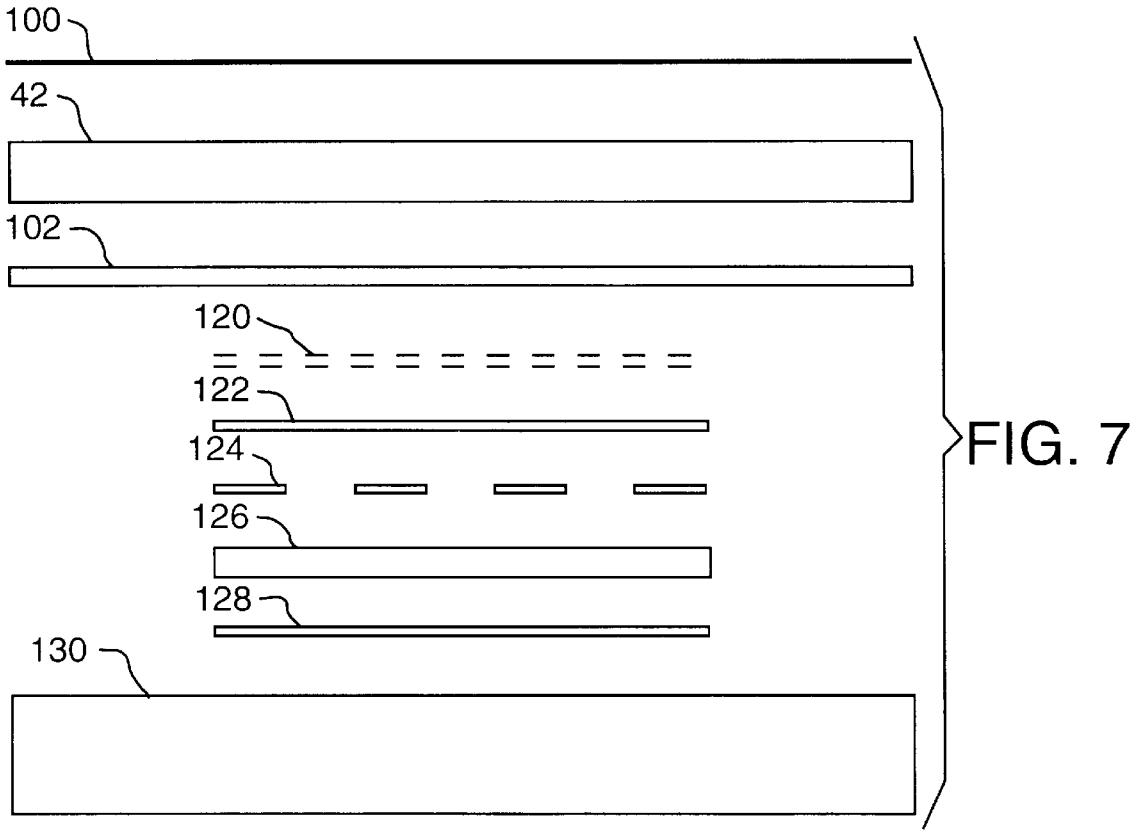
FIG. 7 is an exploded view of a portion of FIG. 5 showing the construction of certain protective aspects of the invention.

Referring to FIG. 7, an exploded view of a preferred embodiment of the invention will be considered. The outer film 42, which is transparent, has an overlying write-resistant coating 100, which may be composed of silicone, polyurethane or tetrafluoride, for example, so as to resist any effort to write or print on the upper surface thereof. Adhesive layer 102, which is preferably a pressure sensitive adhesive and may be employed as a film or coating, underlies the outer film 42. The end user inserted variable data, such as the dates 37,38,39, is shown schematically as being layer 120. The hologram means as described herein will consist of the hologram layer 122 which, in the preferred embodiment, will be embossed and have its upper surface partially or totally metallized. Underlying that will be a layer 124 which has portions of differential adhesion properties. Underlying that is a film 126 which may be made of polyester or polyvinyl chloride, for example, and an adhesive layer 128 underlies that. The adhesive layer 128 serves to secure the hologram to the underlying substrate 130 which may be made of cardboard or a resinous plastic material, such as vinyl or polyester or other suitable materials.

Considering a method of the present invention, the outer film 42 may be hinged to the article, as shown in FIGS. 1 and 2, with a strippable protective web 16 applied to the outer film 42. Lower surface 105 has adhesive layer 102 secured thereto. The hologram 122,124,126 is adhesively secured to substrate 130 by adhesive layer 128, which may be pressure sensitive, hot melt, or hot stamping adhesives, for examples. The variable data 120 is then applied to the hologram upper surface 122 and the substrate 130. After that, the outer film 42 has strippable protective web 16 removed and is adhesively secured to the hologram 122 upper surface and upper surface of substrate 130 with the variable data sealed between (a) the outer film 42 and (b) the hologram 122 and substrate 130.

Figure 8:
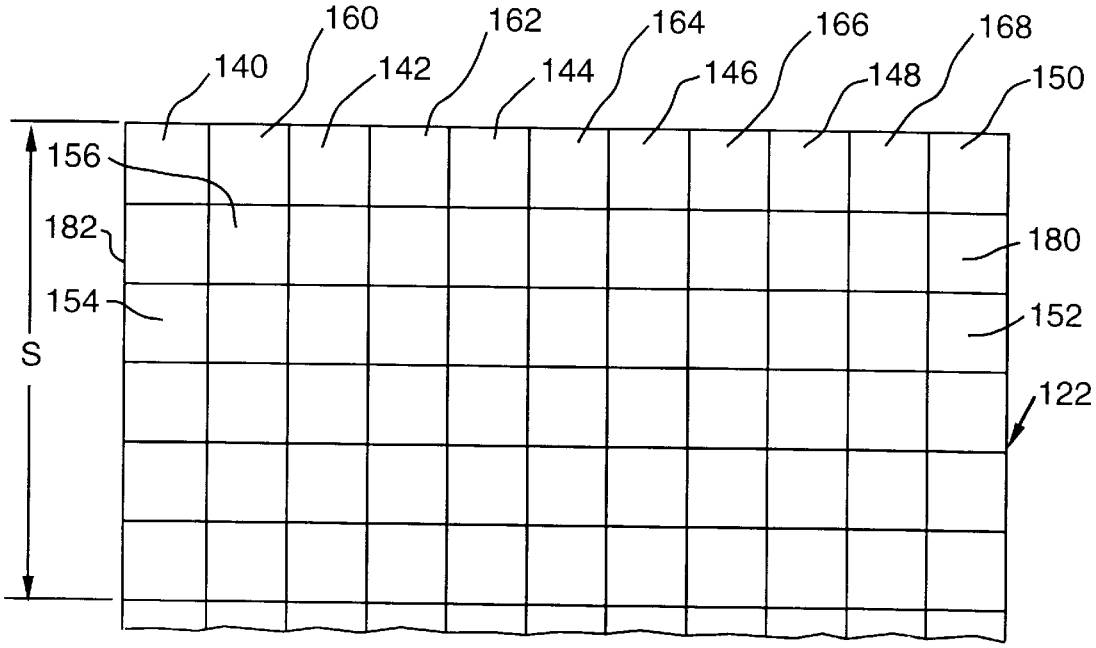
FIG. 8 is a fragmentary plan view showing a portion of the differential release/adhesive promotion segments of the present invention.

Referring to FIG. 8, there is shown layer 124, which preferably has a height S, generally coextensive with the hologram layer 122. This layer 124 will preferably have a plurality of portions which have release characteristics and other portions which have adhesive characteristics in order to establish differential capability of securing the hologram layer 122. For example, in the checkerboard form shown, alternate blocks could have less adhesive characteristics or be release in nature, as distinguished from other blocks which have greater adhesive properties.

These features may be achieved by providing a layer of release materials, such as a silicone, for example, within the first portions, such as 140,142,144,146,148,150,152,154,156, for example, with all the alternate blocks having greater relative adhesive properties which may be achieved by applying tie-coat. The tie-coat blocks, in the example shown, would, for example, include blocks 160,162,164,166,168,180,182 and additional alternate blocks. It will be appreciated that the goal is to achieve differential adhesive adhering properties in certain portions of the layer 122 as compared with others. The natural characteristic of the hologram material may be relied on for the characteristic desired in certain portions and a coating of one type be provided in another, or coatings or other layers of material may be provided in both categories of portions. Also, the release portions and adhesive promoting portions may be in any desired shape and location. It will be preferred to have the adhesive enhancing means occupy about 30 to 60 percent of the area of layer 124 and about 40 to 70 percent of the area occupied by release coated portions.

Figure 9:
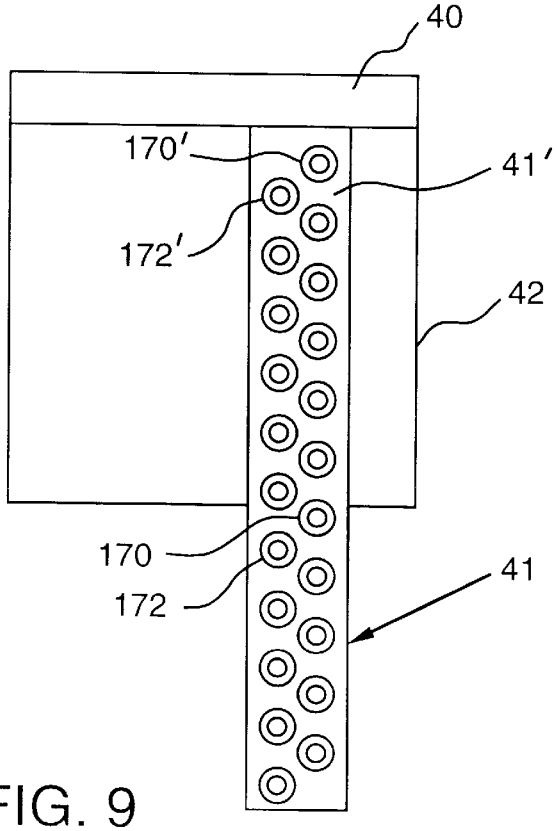
FIG. 9 is an end elevational view showing a portion of the outer film and a partially removed hologram strip.

The portions of the hologram 122, which overlie release portions 140–156 (even numbers only), will be lifted and secured by adhesive means 102 to the removed outer film 36. Those portions which have adhesive enhancing characteristics will remain on the film 126 and will, therefore, be part of the underlying hologram. As a result, removal of the hologram as a unit will be resisted. Considering, for example, FIG. 9 wherein the film 42 is associated with hologram 41 having embossed portions 170,172, other portions 170', 172', for example, remain with the outer film 42. As a result, any effort to remove the hologram as a unit will be defeated.

Figure 10:
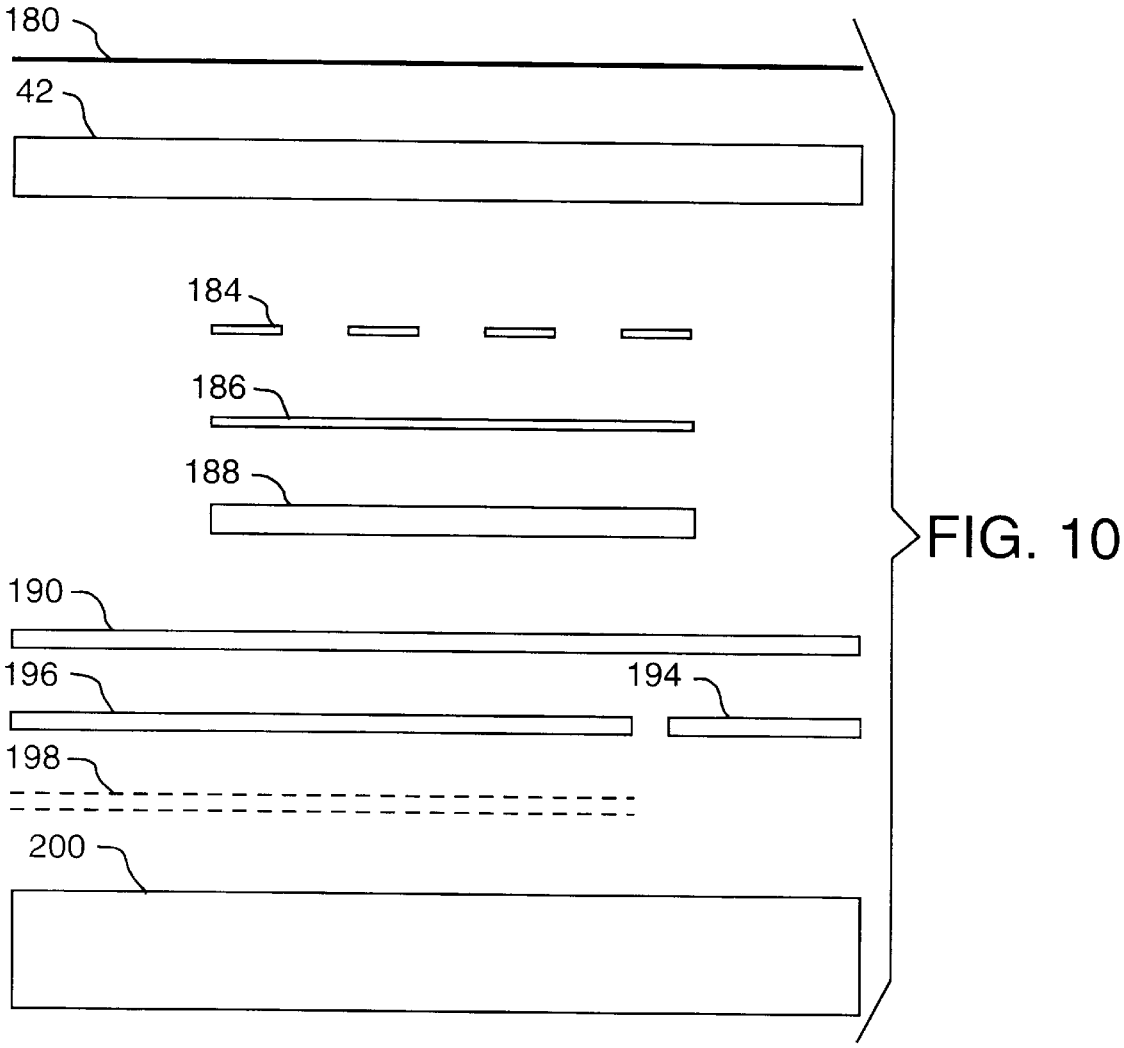
FIG. 10 is an exploded view similar to FIG. 7, but showing a different embodiment of the invention.

Referring to FIG. 10, another embodiment will be considered. In this embodiment, the hologram will be clear at least in part and will overlie the variable data. The variable data will underlie the hologram, rather than overlying it as in the embodiment of FIGS. 5 through 9. In this embodiment, a write-resistant layer 180 is secured to outer film 42 and layer 184 has portions of relative enhanced release properties and portions of relative enhanced adhesive properties. The embossed hologram 186 is transparent, but may, if desired, have a partially metallized underlying layer 188. A pressure sensitive adhesive layer 190 has a pair of strippable liner members 194,196. In use, liner 194 is removed and adhesive layer 190, in the region overlying substrate 200, is secured thereto with the upper assembly being rotated about the portion of 190 secured to substrate 200. Variable data 198 is then applied to the upper surface of substrate 100, liner 196 is removed, and the upper assembly 180-42-184-186-188-190 is secured over the variable data 198. Any effort to remove outer film 182 will irreversibly fracture hologram 186–188 and remove portions of the substrate. If desired, the differential release/adhesion layer 184 may be eliminated.

It will be appreciated that the present invention provides a simple and effective means of resisting both counterfeiting and alteration of informational articles, such as temporary vehicle registration plates. The invention is sufficiently inexpensive to use as to be adapted for use in disposable items.

It will be appreciated that while prime focus of the invention has been directed toward temporary vehicle registration plates, it may be used in other environments wherein counterfeit and alteration protection is desired with particular emphasis in those instances where the creator and authorized user of the form is not the one who puts in additional information. For example, industrial or governmental vehicular or individual dated or coded security passes may be rendered more reliable by the present invention. While for convenience of disclosure reference has been made herein to use of the invention on paper or paperboard articles, the invention is not so limited. It may be used on plastic, metal, or laminated materials, for example. A vinyl or polyvinylchloride may be employed, if desired.

It will be appreciated that the present invention provides an effective means for using any one of the security enhancing embodiments or combinations thereof to resist alteration of an article. The product and the associated method may be employed economically and effectively to protect end user inserted information from undesired alteration or counterfeiting. The concepts employed include holograms, metallized holograms, hologram particles, patterns, differential ink viscosities, and differential adhesive and release characteristics.

While for purposes of illustration examples involving vehicle temporary registration permits have been employed and such an end use is advantageous in the context of the present invention, it will be appreciated that the invention will have application in additional uses where it is desired to resist undesired alteration of variable data applied to a pre-existing form.

Words of orientation, such as "upper," "lower," "outer," and "inner" and the like have been employed herein for convenience of reference only and are not to be deemed limitations on the invention unless clearly indicated to the contrary in a specific location.

Whereas particular embodiments of the invention have been described above for purposes of illustration, it will be evident to those skilled in the art that numerous variations of the details may be made without departing from the invention as defined in the appended claims.

I claim:

1. An alteration resistant article containing variable data comprising an outer film having an upper surface and a lower surface, adhesive means secured to said outer film lower surface, hologram means for receiving variable data thereon underlying said adhesive means and secured to at least portions of said adhesive means, said hologram means having a hologram layer and an underlying portions which have release properties so that portions of said hologram layer overlying said release portions will be bonded to said overlying adhesive means more intimately than other portions of said hologram layer, whereby separation of said outer film from said hologram means will result in fragmentation of said hologram layer with said hologram layer portions overlying said release properties remaining secured to said outer film lower surface, and substrate means underlying said hologram means and being adhesively bonded thereto.

2. The alteration resistant article of claim 1 including said alteration resistant article being a vehicle temporary registration permit.

3. The alteration resistant article of claim 2 including a plurality of hologram particles disposed within at least one of (a) said outer film, (b) said adhesive means, and (c) the interface between said outer film and said adhesive means.

4. The alteration resistant article of claim 1 including said hologram means being of a lesser height than said outer film, and said substrate having an upper surface which is printed with pattern means.

5. The alteration resistant article of claim 1 including said hologram means having an upper surface which is at least partially metallized.

6. The alteration resistant article of claim 1 including portions of said hologram means other than portions having release properties being coated with an adhesive enhancing layer.

7. The alteration resistant article of claim 6 including said release properties being obtained by coating said portions of said hologram means with release coating means.

8. The alteration resistant article of claim 1 including a write-resistant layer disposed on said upper surface of said outer film.

9. The alteration resistant article of claim 1 including said hologram means including an embossed layer overlying an inner film with said release property containing portions being disposed therebetween and an adhesive layer underlying said inner film and securing said film to said substrate.

10. The alteration resistant article of claim 9 including said embossed layer having an upper surface which has been at least partially metallized.

11. The alteration resistant article of claim 4 including said pattern means being substantially completely disposed on said substrate upper surface, whereby removal of said outer film will remove underlying portions of said pattern means.

12. The alteration resistant article of claim 11 including said pattern means being established by printing with high viscosity ink which resists penetration into said substrate.

13. The alteration resistant article of claim 1 including said outer layer being transparent.

14. The alteration resistant article of claim 1 including said hologram means having a lesser height than said outer film, whereby portions of said variable data will be disposed between said lower surface of said outer film and the upper surface of said hologram means and other portions of said variable data will be disposed between said lower surface of said upper film and the upper surface of said substrate.

15. An alteration resistant article containing variable data comprising an outer film having an upper surface and a lower surface, hologram means underlying said outer film, said hologram means being at least partially transparent, adhesive means secured to the undersurface of said out film and said hologram means, removable liner means secured to the undersurface of said adhesive means, substrate means underlying said adhesive means, and said removable liner means, and said substrate means having an upper surface for receiving variable data, whereby removal of said liner means will permit securement of said hologram means and said outer film to said substrate means overlying said variable data.

16. The alteration resistant article of claim 15 including said hologram means including a hologram, an overlying layer having portions of enhanced release properties and portions of enhanced adhesive properties, and an underlying layer which is partially metallized.

17. The alteration resistant article of claim 15 including said alteration resistant article being a vehicle temporary registration permit.

18. The alteration resistant article of claim 15 including said hologram means being of a lesser height than said outer film, and said substrate having an upper surface which is printed with pattern means.

19. The alteration resistant article of claim 15 including a plurality of hologram particles disposed within at least one of (a) said outer film, (b) said adhesive means, and (c) the interface between said outer film and said adhesive means.

20. The alteration resistant article of claim 16 including portions of said hologram means other than portions having said enhanced release properties being coated with an adhesive enhancing layer, and said enhanced release properties being obtained by coating said portions of said hologram means with release coating means.

21. The alteration resistant article of claim 15 including a write-resistant layer disposed on said upper surface of said outer film.

22. The alteration resistant article of claim 18 including said pattern means being substantially completely disposed on said substrate upper surface, whereby removal of said outer film will remove underlying portions of said pattern means.

23. An alteration resistant article containing variable data comprising an outer film having an upper surface and a lower surface, adhesive means secured to said outer film lower surface, hologram means for receiving variable data thereon underlying said adhesive means and secured to at least portions of said adhesive means, a plurality of hologram particles contained within at least one of (a) said outer film, (b) said adhesive means, and (c) the interface between said outer film and said adhesive means, and substrate means for receiving variable data and underlying said hologram means and being adhesively bonded thereto.

24. The alteration resistant article of claim 23 including said hologram means having portions which have release properties so as to be bonded to said overlying adhesive means more intimately than other portions of said holograph means, whereby separation of said outer film from said hologram means will result in fragmentation of said hologram with said portions having said release properties remaining secured to said outer film lower surface.

25. The alteration resistant article of claim 23 including said alteration resistant article being a vehicle temporary registration permit.

26. The alteration resistant article of claim 24 including said hologram means having an upper surface which is at least partially metallized.

27. The alteration resistant article of claim 24 including said hologram means being of a lesser height than said outer film, and said substrate having an upper surface which is printed with pattern means.

28. The alteration resistant article of claim 27 including said pattern means being substantially completely disposed on said substrate upper surface, whereby removal of said outer film will remove underlying portions of said pattern means.

* * * * *

UNITED STATES PATENT AND TRADEMARK OFFICE

CERTIFICATE OF CORRECTION

PATENT NO. : 5,913,543
DATED : June 22, 1999
INVENTOR(S) : Yoram Curiel

It is certified that error appears in the above-identified patent and that said Letters Patent is hereby corrected as shown below:

Col. 2, line 7 after the word "can", insert the word "be".

Col. 8, line 48, the word "tile" should read --the-- as originally submitted.

Column 11, line 49, delete the word "an".

Signed and Sealed this

Twenty-sixth Day of December, 2000

*Attest:*

*Attesting Officer*

Q. TODD DICKINSON

*Director of Patents and Trademarks*